US006276362B1

(12) United States Patent
Chen-Lieh

(10) Patent No.: US 6,276,362 B1
(45) Date of Patent: Aug. 21, 2001

(54) DIVING SNORKEL

(75) Inventor: Pan Chen-Lieh, Ilan Hsing (TW)

(73) Assignee: QDS Injection Molding Inc., San Diego, CA (US)

( * ) Notice: Subject to any disclaimer, the term of this patent is extended or adjusted under 35 U.S.C. 154(b) by 0 days.

(21) Appl. No.: 09/568,158

(22) Filed: May 10, 2000

(51) Int. Cl.[7] ..... B63C 11/16
(52) U.S. Cl. ..... 128/201.11; 128/201.27
(58) Field of Search ..... 128/201.11, 201.26–201.29, 128/200.29, 206.29, 912; 405/186, 187; 181/127, 27

(56) References Cited

U.S. PATENT DOCUMENTS 4,805,610 * 2/1989 Hunt ..... 128/201.11
4,884,564 * 12/1989 Lamont ..... 128/201.11
5,092,324 * 3/1992 Christianson ..... 128/201.11
5,280,785 * 1/1994 Fujima ..... 128/201.11
5,529,057 * 6/1996 Ferrero et al. ..... 128/201.11
6,073,626 * 6/2000 Riffe ..... 128/201.11
6,129,081 * 10/2000 Wu ..... 128/201.11

* cited by examiner

*Primary Examiner*—John G. Weiss
*Assistant Examiner*—Teena Mitchell
(74) *Attorney, Agent, or Firm*—Dougherty & Troxell

(57) ABSTRACT

A diving snorkel having a mouth portion and a main pipe molded from thermoplastic materials. There are two extending folding pieces and two matching recesses on the upper end. After the two folding pieces are pressed into the recesses by the external force, an anti-water piece is formed.

5 Claims, 3 Drawing Sheets

DIVING SNORKEL

FIELD OF THE INVENTION

This invention relates to diving snorkel allowing a diver to breath as the diver swims under water.

BACKGROUND OF THE INVENTION

Typical structure of diving snorkel (as shown in FIG. 1) is generally divided into three parts: a mouth portion is below, a breathing tube is in the middle and an anti-water piece is above. The mouth portion is a hollow tubular structure, and includes three passages: a passage passes up to the breathing tube; a passage in a bending tube that passes to the mouthpiece; and another downward passage passes to a water outlet. There is a non-return valve provided on the water outlet, such that the water can be let out and cannot come back in. The bore breathing tube is a hollow tube and connects up to the anti-water piece and down to the mouth piece. The anti-water piece reduces the water coming in as much as possible and allows air to come in. The air passes up to the mouthpiece through the breathing tube. The water falls into the water outlet of the mouthpiece along the breathing tube due to gravity and the water outflows downward from the non-return valve due to the pressure that the diver may intensely breathe out through the mouthpiece to expel out the water. These three parts are generally manufactured separately, and are assembled by means of preset clamping members. Most products which are commercially available belong to these types.

SUMMARY OF THE INVENTION

The object of the present invention is to provide a structure in which the anti-water piece and the breathing tube can be directly molded together, above has a function of the against water piece, with a down side having a function of the bore breathing tube, and a diving snorkel is assembled with the mouth portion by means of manual pressure deformation.

DESCRIPTION OF THE PREFERRED EMBODIMENTS

Figure 1:
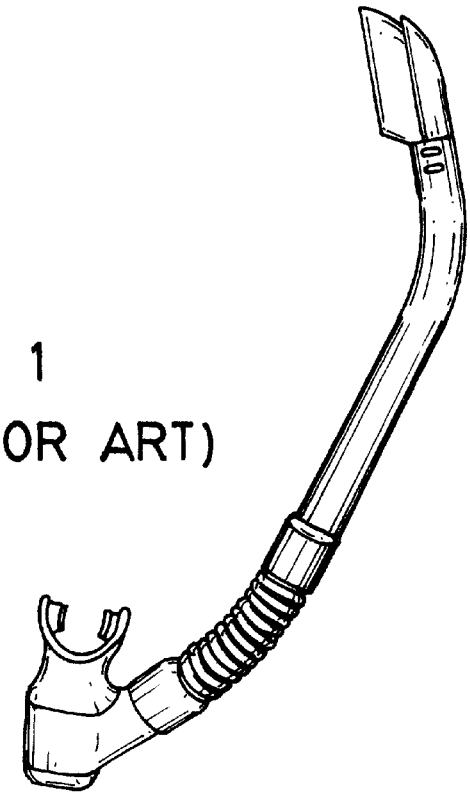
FIG. 1 (PRIOR ART)
FIG. 1 is a side view of a prior art.
Figure 2:
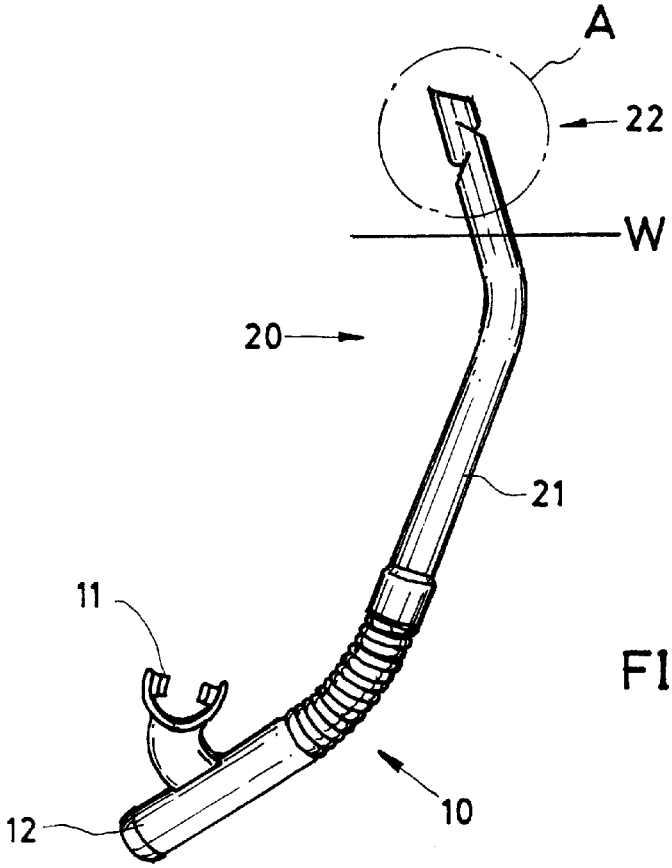
FIG. 2 is a side view of a breathing tube of the present invention.

As shown in FIG. 2 the constitution of the breathing tube for the present invention includes a mouth portion 10 and a main pipe 20. The structure of the mouth portion 10 is the same as the conventional structure, main pipe 20 includes an air pipe 21 and an anti-water device 22, usually above line W which represents approximately the water level. The constitution of the mouth portion 10 includes a mouthpiece 11 and a bottom chamber 12. The mouthpiece 11 is the same as the conventional device, in which the air is directed to the mouthpiece by a bending air pipe. The water above the main pipe 20 can be received in the bottom chamber 12, with a non-return valve provided below the bottom chamber 12, which enables outflow of the water.

Figure 3:
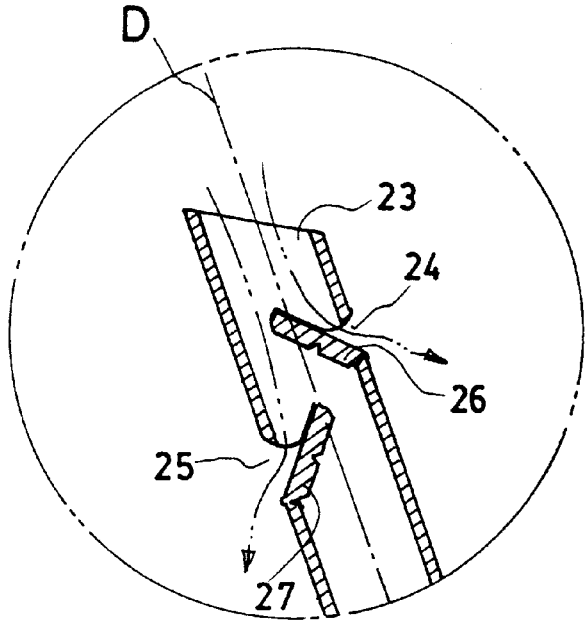
FIG. 3 is a sectional view of the enlarged area A in FIG. 1.

FIG. 3 is an enlarged sectional view of anti-water device 22 including an opening 23, two water outlets 24, 25, and two waterproof pieces 26, 27. The opening 23 provides an inlet and an outlet for air. The two waterproof pieces 26, 27 crisscross each other, each front edge crossing centerline D. The water falling in through the opening 23, is respectively separated by the waterproof pieces 26, 27 and outflows the breathing tube through the water outlet 24, 25. If a slight amount of water remains in the main pipe 20, it will fall to the bottom chamber 12 due to the gravity, and will outflow during breathing out.

Figure 4:
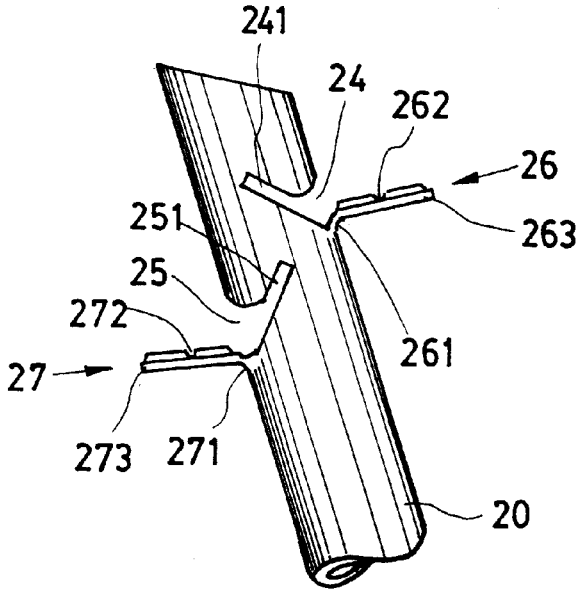
FIG. 4 is a side view of the anti-water piece of the present invention.
Figure 5:
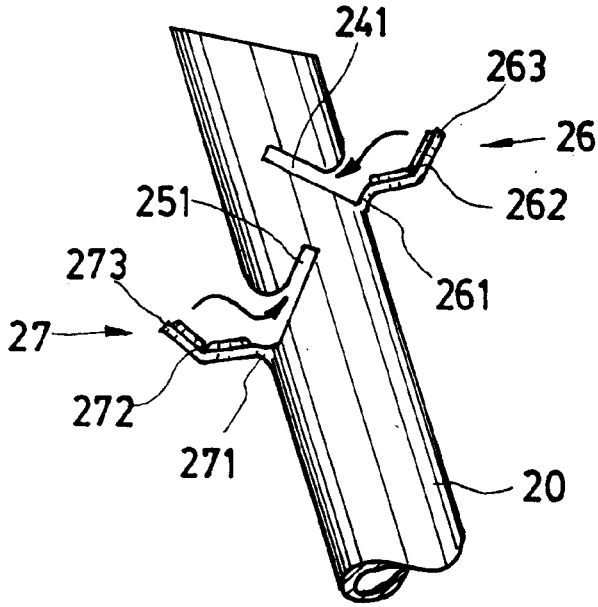
FIG. 5 is a side view showing an action with which the waterproof pieces are placed in the recesses by means of pressure.

FIG. 4 shows a state during manufacture of the main pipe 20 which is made from thermoplastic elastic and flexible materials. There is a waterproof piece 26,27 on each side above the hollow tubular main pipe 20. The waterproof pieces 26, 27 are connected to the pipe body of the main pipe 20, by connecting parts 261, 271 which are thinner than its thickness. There are folding recesses 262, 272 provided in the approximate middle of the waterproof pieces 26, 27. The thickness of the external edges 263, 273 for the waterproof pieces 26, 27 match with the recesses 241, 251 positioned in the water outlets 24, 25. Recesses 241,251 provided on both sides of the holes, which can be inserted by the external edges 263, 273 of the waterproof pieces 26, 27.

After the main pipe 20 is molded with the connected parts 261, 271, the folding recesses 262, 272 are bent by means of pressing on the waterproof pieces 26, 27, such that the external edges 263, 273 are inserted into the recesses 241, 251. The waterproof pieces 26,27 are stretched along the direction of the recesses 241,251 when the pressing pressure is eliminated. At this time the waterproof pieces 26,27 are fixed in the water outlets 25,26 (as shown in FIG. 2 and FIG. 3).

Figure 6:
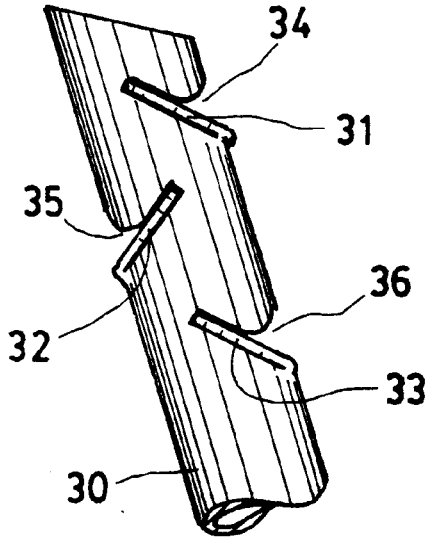
FIG. 6 is a side view of another embodiment for the main pipe of the present invention.

FIG. 6 illustrates another embodiment of the waterproof device which has three waterproof pieces 31, 32, 33 and three water outlets 34, 35, 36. The construction of the waterproof pieces 31,32, 33 is the same as above-mentioned two waterproof slices 26, 27.

The structure below the main pipe 20 is the same as the conventional device which is connected with the mouth portion 10 by clamping.

In summary, the waterproof pieces 26, 27 are fixed in the recesses 241, 251 by means of manual pressure, which is formed during projection molding with the structural design of the main pipe 20, thus forming the water outlets 24, 25. The structure having the anti-water part is formed above the main pipe 20, and is integrated with the breathing tube, enabling easy manufacture and lower cost.

What is claimed is:

1. A diving snorkel comprising:

a) a mouth portion including a mouthpiece; and, b) an elongated main pipe extending from the mouth portion, the main pipe having an end portion located opposite from the mouth portion, the end portion having at least two water outlets through a side wall thereof, a waterproof piece located adjacent to each water outlet and formed integrally with the main pipe, each waterproof piece extending inwardly into an interior of the main pipe such that an edge portion crosses a centerline of the main pipe so as to form an integral anti-water device.

2. The diving snorkel of claim 1 further comprising recesses in the side wall of the main pipe communicating with each water outlet, the recesses being engaged by external edges of the associated waterproof piece.

3. The diving snorkel of claim 2 wherein each waterproof piece has a folding recess in a middle thereof.

4. The diving snorkel of claim 1 further comprising three water outlets in the main pipe.

5. The diving snorkel of claim 1 further comprising a reduced thickness folding portion joining each waterproof piece and the main pipe.

* * * * *